US007929004B2

(12) United States Patent
Wang

(10) Patent No.: US 7,929,004 B2
(45) Date of Patent: Apr. 19, 2011

(54) THERMAL PRINT HEAD POSITIONING DEVICE

(75) Inventor: Yu-Hsiang Wang, Taipei County (TW)

(73) Assignees: Armorlink SH Corp., Min-Sing-Sin-Jhuang Industrial District, Shang-Hai (CN); ICP Electronics, Inc., Shi-Chih, Taipei Hsien (TW)

( * ) Notice: Subject to any disclaimer, the term of this patent is extended or adjusted under 35 U.S.C. 154(b) by 72 days.

(21) Appl. No.: 12/534,867

(22) Filed: Aug. 4, 2009

(65) Prior Publication Data

US 2010/0277560 A1 Nov. 4, 2010

(30) Foreign Application Priority Data

May 4, 2009 (TW) ..... 98207647 U

(51) Int. Cl.
*B41J 25/304* (2006.01)

(52) U.S. Cl. ..... 347/197

(58) Field of Classification Search ..... 347/197, 347/198; 400/120.16, 120.17
See application file for complete search history.

(56) References Cited

U.S. PATENT DOCUMENTS

| | | | | | |
|---|---|---|---|---|---|
| 4,651,165 | A | * | 3/1987 | Shimada | 347/217 |
| 4,755,834 | A | * | 7/1988 | Kunimitsu et al. | 347/177 |
| 4,838,713 | A | * | 6/1989 | Kunimitsu et al. | 400/120.16 |
| 4,911,566 | A | * | 3/1990 | Imaseki et al. | 400/120.16 |
| 4,938,616 | A | * | 7/1990 | Shiozaki et al. | 400/120.16 |
| 4,953,994 | A | * | 9/1990 | Shiozaki et al. | 400/120.16 |
| 5,036,338 | A | * | 7/1991 | Imai | 347/172 |
| 5,062,722 | A | * | 11/1991 | Shiozaki et al. | 400/582 |

* cited by examiner

*Primary Examiner* — Huan H Tran
(74) *Attorney, Agent, or Firm* — Winston Hsu; Scott Margo

(57) ABSTRACT

A thermal print head positioning device is disposed in a printing device having a CPU and comprises a thermal print head, a transmission set is made up by a transmission component and a shaft, a cam, an actuator comprising a rotating shaft, a checking plate comprising a plurality of indentations with different sizes, a sensing component, and a supporting frame. The cam and the checking plate are disposed on the shaft. The actuator is electrically connected to the CPU and utilized for actuating the transmission set. The sensing component is disposed on the checking plate and electrically connected to the CPU, and utilized for sensing the sizes of the indentations to make the CPU determine to accelerate or decelerate the actuator. The supporting frame is connected to the cam and the thermal print head, driven by rotation of the cam to make the thermal print head rise or descend.

3 Claims, 1 Drawing Sheet

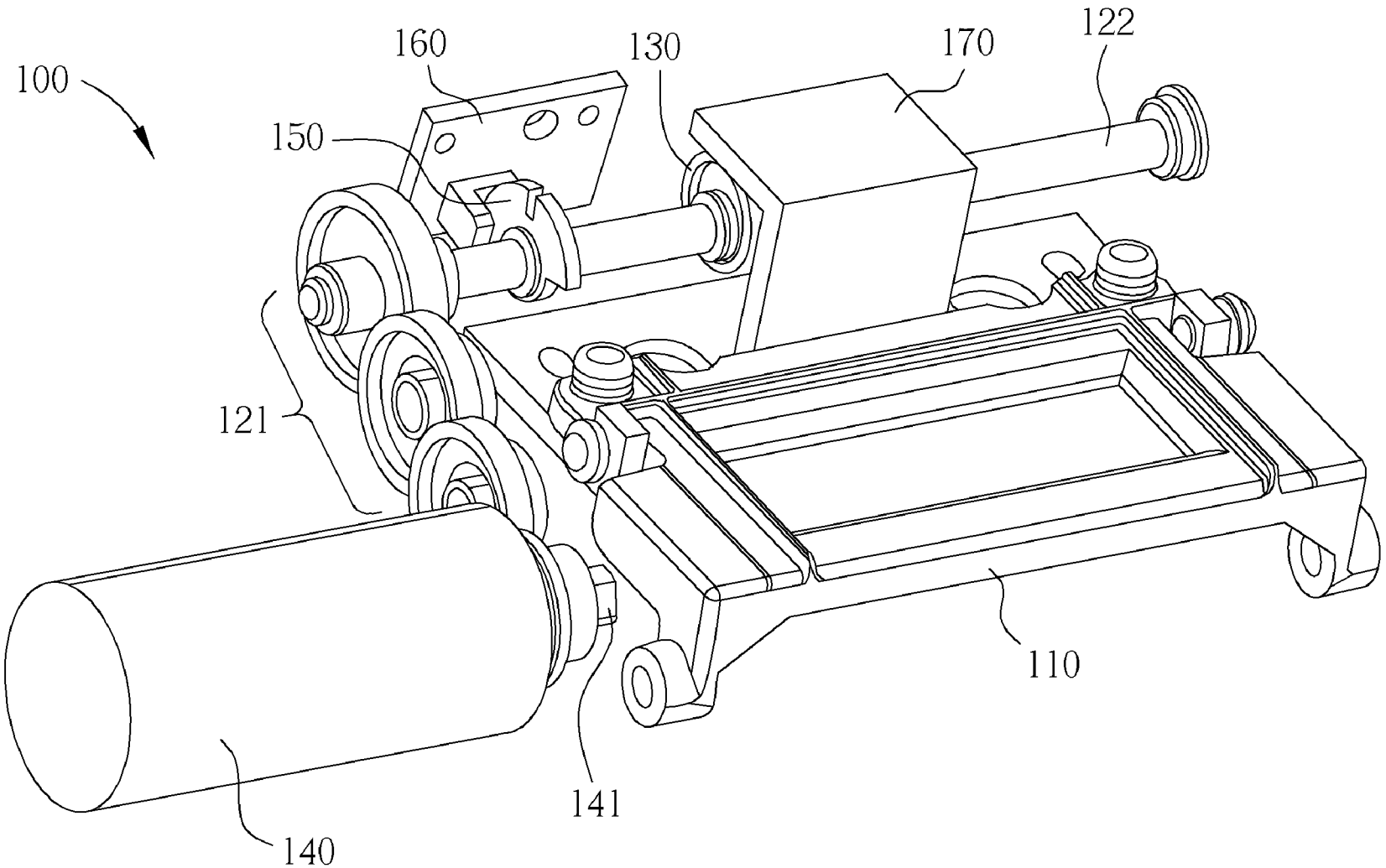
Figure

THERMAL PRINT HEAD POSITIONING DEVICE

BACKGROUND OF THE INVENTION

1. Field of the Invention

The present invention relates to a thermal print head positioning device, and more particularly, to a thermal print head positioning device that utilizes a sensing component to sense a checking plate to position the thermal print head.

2. Description of the Prior Art

The conventional lottery ticket printing devices are mostly using an inside thermal printer and the thermal materials on the thermal paper to cause a reaction to display the information on the thermal paper.

Generally, rising and descending operations of the thermal print head of the thermal printer in the lottery ticket printing device are controlled by solenoid or DC Motor. It is easy to use the solenoid to control the thermal print head, but it results in a big noise problem in control operations. Rising and descending operations of the thermal print head can be controlled by the DC Motor with sensor. However, due to inertia motion, when the sensor senses a position, the shaft will have overshoot and the thermal print head can not be positioned accurately even the DC Motor is turned off immediately. When the DC Motor operates at a slower velocity, the thermal print head can be positioned. However, the printing efficiency of the printing device will be reduced due to the slower velocity.

It is therefore one of the objectives of the present invention to provide a thermal print head positioning device that utilizes an improved checking plate to position the thermal print head, so as to solve the above problems.

SUMMARY OF THE INVENTION

It is therefore one of the objectives of the present invention to provide a thermal print head positioning device that utilizes a sensing component to sense indentations of a checking plate to make a CPU determine to accelerate or decelerate a motor output, so as to accurately position the thermal print head.

In accordance with an embodiment of the present invention, a thermal print head positioning device is disclosed. The thermal print head positioning device is disposed in a printing device having a CPU, and comprises: a thermal print head, a transmission set, a cam, an actuator, a checking plate, a sensing component, and a supporting frame. The transmission set is made up by a transmission component and a shaft. The cam is disposed on the shaft. The actuator is electrically connected to the CPU, and comprises a rotating shaft connected to the transmission set, and utilized for actuating the transmission set to rotate. The checking plate is disposed on the shaft, and comprises a plurality of indentations with different sizes. The sensing component is disposed on the checking plate and electrically connected to the CPU, and utilized for sensing the sizes of the indentations to make the CPU determine to accelerate or decelerate the actuator. The supporting frame is respectively connected to the cam and the thermal print head, and driven by rotation of the cam to make the thermal print head rise or descend.

In the thermal print head positioning device of the present invention, the transmission component can be made up by a plurality of gears, and the actuator can be a DC motor.

Since the thermal print head positioning device of the present invention utilizes the sensing component to sense a plurality of indentations with different sizes of the checking plate to make a CPU determine to accelerate or decelerate a motor output, the thermal print head will not be in wrong position due to inertia motion, and the printing efficiency of the printing device will not be reduced.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

The FIGURE shows a diagram of a thermal print head positioning device in accordance with an embodiment of the present invention.

DETAILED DESCRIPTION

Please refer to the FIGURE. The FIGURE shows a diagram of a thermal print head positioning device 100 in accordance with an embodiment of the present invention.

The thermal print head positioning device of the present invention is disposed in a printing device having a CPU (not shown), and comprises: a thermal print head 110, a transmission set (not shown), a cam 130, an actuator 140, a checking plate 150, a sensing component 160, and a supporting frame 170. The transmission set is made up by a transmission component 121 and a shaft 122. The cam 130 and the checking plate 150 are disposed on the shaft 122. The actuator 140 is electrically connected to the CPU, and comprises a rotating shaft 141 connected to the transmission set. The sensing component 160 is disposed on the checking plate 150 and electrically connected to the CPU. The supporting frame 170 is respectively connected to the cam 130 and the thermal print head 110. The CPU can control the actuator 140 to rotate and make the rotating shaft 141, the transmission component 121, and the shaft 122 rotate with each other, so as to make the thermal print head 110 rise or descend.

When the printing device is powered on, the sensing component 160 firstly senses sensing position of the checking plate 150 in the sensing component 160, and senses the sizes of the indentations of the checking plate 150 to make the CPU determine to accelerate or decelerate the actuator 140, so as to position the thermal print head 110 to a rising position. Thus, if the printing device meets a power failure condition during a printing operation, the sensing component 160 can immediately sense the checking plate 150 and position the thermal print head 110 after the power is recovered. In this way, the position of the thermal print head 110 will not be wrong in the printing operation of the printing device after the power is recovered, and thus there is no printing problem after the power is recovered.

In the thermal print head positioning device 100 of the present invention, the transmission component 121 can be made up by a plurality of gears, and the actuator 140 can be a DC motor.

In the embodiment shown in the FIGURE, the checking plate 150 has a big indentation and a small indentation. When the sensing component 160 senses the big indentation, the sensing component 160 will accelerate the actuator 140 output to position the thermal print head 110 to a descending position. When the sensing component 160 senses that the checking plate 150 reaches an end position of the big indentation, the sensing component 160 will inform the CPU to decelerate the actuator 140 output or disable the actuator 140, so as to position the thermal print head 110 to a rising position. When the sensing component 160 senses the small indentation, the sensing component 160 will accelerate the actuator 140 output or enable the actuator 140. Finally, when the sensing component 160 senses that the checking plate 150 reaches an end position of the small indentation, the sensing component 160 will inform the CPU to decelerate the actuator 140 output or stop the actuator 140, so as to position the thermal print head 110 to a final rising position.

In this embodiment of the present invention, the checking plate has two indentations with different sizes. However, this is only for an illustrative purpose and is not meant to be a limitation of the present invention. The checking plate can have more indentations with different sizes, and the sensing component can sense the sizes of the indentations of the checking plate to inform the CPU to control output velocity of the actuator 140 in multi-level, so as to make the method of controlling the thermal print head in the printing device to rise or descend more efficient.

Those skilled in the art will readily observe that numerous modifications and alterations of the device and method may be made while retaining the teachings of the invention.

What is claimed is:

1. A thermal print head positioning device, disposed in a printing device having a CPU, comprising:

a thermal print head;

a transmission set, made up by a transmission component and a shaft;

a cam, disposed on the shaft;

an actuator, electrically connected to the CPU, comprising a rotating shaft connected to the transmission set, for actuating the transmission set to rotate;

a checking plate, disposed on the shaft, comprising a plurality of indentations with different sizes;

a sensing component, disposed on the checking plate and electrically connected to the CPU, for sensing the sizes of the indentations to make the CPU determine to accelerate or decelerate the actuator; and a supporting frame, respectively connected to the cam and the thermal print head, driven by rotation of the cam to make the thermal print head rise or descend.

2. The thermal print head positioning device of claim 1, wherein the transmission component is made up by a plurality of gears.

3. The thermal print head positioning device of claim 1, wherein the actuator is a DC motor.

* * * * *